US005967952A

United States Patent [19]

Bronstein et al.

[11] Patent Number: 5,967,952

[45] Date of Patent: Oct. 19, 1999

[54] COLLAPSIBLE AQUATIC/LAND WEIGHT TRAINING SYSTEM

[76] Inventors: Laurie Bronstein; Holly Ann Firuta, both of 718 Hendren St., Philadelphia, Pa. 19128

[21] Appl. No.: 08/987,059

[22] Filed: Dec. 9, 1997

Related U.S. Application Data

[60] Provisional application No. 60/039,561, Feb. 28, 1998, provisional application No. 60/039,562, Feb. 28, 1997, and provisional application No. 60/045,960, May 8, 1997.

[51] Int. Cl.[6] ..... A63B 21/065; A63B 21/075

[52] U.S. Cl. ..... 482/111; 482/93; 482/105; 482/106; 482/108

[58] Field of Search ..... 482/93, 111, 106–108, 482/105

[56] References Cited

U.S. PATENT DOCUMENTS

| | | |
|---|---|---|
| 1,611,427 | 12/1926 | Evans . |
| 2,644,890 | 7/1953 | Hollihan . |
| 2,780,378 | 2/1957 | Romano . |
| 3,231,270 | 1/1966 | Winer . |
| 3,278,184 | 10/1966 | Rosenbaum . |
| 3,334,899 | 8/1967 | Bosko et al. . |
| 3,427,020 | 2/1969 | Montour et al. . |
| 3,528,652 | 9/1970 | Tarbox . |
| 3,781,007 | 12/1973 | Baker et al. . |
| 3,820,179 | 6/1974 | Maertin . |
| 3,835,493 | 9/1974 | Grivna . |
| 3,910,577 | 10/1975 | Boyle . |
| 4,029,312 | 6/1977 | Wright . |
| 4,076,236 | 2/1978 | Ionel . |
| 4,103,887 | 8/1978 | Shoofler . |
| 4,193,518 | 3/1980 | Holmes . |
| 4,199,140 | 4/1980 | Ferretti . |
| 4,311,306 | 1/1982 | Solloway . |
| 4,322,072 | 3/1982 | White . |
| 4,357,009 | 11/1982 | Baker . |
| 4,480,829 | 11/1984 | Yacoboski . |
| 4,492,313 | 1/1985 | Touzani . |
| 4,509,744 | 4/1985 | Beasley . |
| 4,565,369 | 1/1986 | Bedgood . |
| 4,627,618 | 12/1986 | Schwartz . |
| 4,671,507 | 6/1987 | Huttner . |
| 4,695,051 | 9/1987 | Jenison . |
| 4,804,326 | 2/1989 | Lennon . |
| 4,838,546 | 6/1989 | Winston . |
| 4,854,575 | 8/1989 | Wilson et al. . |

(List continued on next page.)

OTHER PUBLICATIONS

AQUA BELLS Flyer (undated), 2 sheets.

*Primary Examiner*—John Mulcahy
*Attorney, Agent, or Firm*—Jim Zegeer

[57] ABSTRACT

A portable aquatic/land weight training system and method comprises a plurality of collapsible weight chamber members. Each of the collapsible weight chamber members includes a pair of flexible end members joined by first and second flexible band members forming a water- and air-tight chamber. The first band member forms an opening through the collapsible weight chamber member. The opening has a diameter D so as to pass a bar therethrough. Each weight chamber has a water valve and water valve closure member for filling the weight member with water and an air valve and air valve closure member for filling the weight chamber member with air. Each weight chamber member has a peripheral edge and the water valve is located near the peripheral edge of the weight chamber member so that the water valve closure member and the peripheral edge can be grasped by a pair of fingers to close the water valve to sealing relation without significant expulsion of water. The bar is comprised of a plurality of a fixed telescoping and interlocking bar members to constitute a barbell or dumbbell. Each chamber is presized so that when completely filled with water it achieves a predetermined weight, i.e. 1, 2, 3, 5 lbs. This avoids the sloshing of water and sudden weight shifts which occur when attempting to vary the weight of single sized chambers. In addition, the chambers are presized to be inserted into the pouches of a limb or trunk encircling device; for example, to enable mounting "weights" around the ankle for leg-strengthening exercise on land or in water.

2 Claims, 7 Drawing Sheets

U.S. PATENT DOCUMENTS 4,854,576 8/1989 McWain .
4,896,879 1/1990 Klawitter .
4,905,991 3/1990 Alston .
4,905,992 3/1990 McWain .
4,913,422 4/1990 Elmore et al. .
4,951,940 8/1990 Vitello et al. .
4,966,365 10/1990 Winston .
4,995,604 2/1991 Lynch et al. .
4,997,183 3/1991 Winston .
4,997,184 3/1991 Sherman .
5,010,596 4/1991 Brown et al. .
5,033,739 7/1991 MacKechnie ..... 482/108
5,050,870 9/1991 Pollock .
5,056,778 10/1991 Hull et al. .
5,072,935 12/1991 McWain .
5,087,217 2/1992 Tuan et al. .
5,184,993 2/1993 Dowdeswell .
5,190,489 3/1993 Yeung .
5,203,753 4/1993 Rothhammer .
5,266,069 11/1993 Thorne .
5,300,001 4/1994 Sealy .
5,379,909 1/1995 Roark .
5,391,133 2/1995 Ruffa .
5,393,230 2/1995 Vizintin et al. .
5,431,615 7/1995 Correll .
5,445,587 8/1995 Brown .
5,449,333 9/1995 Carter .
5,509,877 4/1996 Adams .
5,514,056 5/1996 Ronca .
5,531,657 7/1996 Macedo .
5,542,896 8/1996 Qaiesi et al. .
5,580,343 12/1996 Cafiero .

COLLAPSIBLE AQUATIC/LAND WEIGHT TRAINING SYSTEM

CROSS-REFERENCE TO RELATED APPLICATIONS

The present invention is based on provisional applications Ser. Nos. 60/039,561 filed Feb. 28, 1998; 60/039,562 filed Feb. 28, 1997 and 60/045,960 filed May 8, 1997.

BACKGROUND OF THE INVENTION

In an accompanying Information Disclosure Statement, we disclose a large number of fitness/muscle-strengthening weight systems. These include disclosures of various forms of hollow weight members which are fillable with water, sand or other fluids or fluent materials, some of which are collapsible and some of which are semi-collapsible. FIG. 1 discloses a commercially available water inflatable weight system marketed under the trademark AQUABELLS in which vinyl water chambers W have a valve V which is placed under a water faucet to fill the chamber with water. To remove any air pockets, the valve V is pulled up until the water overflows. Then the valve is closed so as to seal the water in and pushed back down so it will be flush with the sidewall. The weights W are then placed on a plastic bar B, and threaded plastic bolts PB are engaged with threaded ends TE of the plastic bar B to secure the weights in place. Foam material F cushion the grips.

THE PRESENT INVENTION

The object of the present invention is to provide an improved fitness/muscle-strengthening "weight" system in which the weights are separate hollow chambers fillable with air or water and made of pliable, durable material such as vinyl, making the chambers readily collapsible. These chambers vary in size and are provided with two valves: (1) an air valve and (2) a water valve for selectively introducing and filling the chamber with water and/or air. Each size chamber accommodates different amounts of water which, when completely full, obtains a specific predetermined weight capacity (for example 1 lb., 2 lbs., 3 lbs.) and then fitted in a bar or, alternatively, on a sock/leg fitment, used for conventional weight training exercises on land, or when filled with air for resistive exercise in an aquatic setting. Each of the chambers is provided with a pair of sealable openings for ease of filling with water and a separate valve for ease of filling with air and may be used in conjunction with one another to ease filling and emptying of either substance.

One or more of the chambers may be used to vary the amount of weight and/or buoyancy of various muscle-strengthening devices such as dumbbells, barbells, leg weights, trunk encircling devices, etc. For example, two or more "weights" may be mounted onto a dumbbell bar to obtain the amount of weight and/or buoyancy desired. The same chambers or weights are sized such that they are compatible for multiple uses such as mounted on a dumbbell bar, or inserted into securement devices as "weights" on a leg-strengthening device. Moreover, since each chamber is presized, this eliminates sloshing and sudden weight shift experienced when filling a single size chamber with less water should less weight be desired. The weights are readily portable since the hollow chamber collapses and are light-weight when emptied of water. They provide means for both land and water fitness training. Each of the chambers may be filled with air to provide a buoyancy effect for resistive exercise in the aquatic environment.

In a preferred embodiment, each weight member or chamber is comprised of a pair of flexible end members joined by first and second flexural band members forming a water and air-tight chamber. The first band member forms an opening through which a bar may pass and a water valve for filling the weight with water and an air valve for filling the member with air.

Each weight member has a peripheral edge, and the water valve is located near the peripheral edge so that the valve closure member and a peripheral edge of the weight member can be grasped between the thumb and forefinger or index finger of a user such that the valve closure can be pressed into closing/sealing relation without expelling significant water from the chamber. Moreover, the air valve can be opened so as to facilitate the water entry, which is a much more dense or viscous material than air. Moreover, the air valve allows the egress of air to the atmosphere and also can be used as a better way of allowing egress of water when draining the weight members for storage and/or for assuring that all of the water has been drained from the weight chambers.

Each dumbbell bar has two predrilled holes on one side of weight mounting areas that allow two dumbbell bars to be interconnected by a connector bar equipped with a spring-loaded detent pins on each end. The connector bar inserts into one end of each dumbbell bar with pins inserting into the predrilled holes to secure connector bar to dumbbell bars. This creates a barbell onto which collapsible chambers may be mounted for a greater variety of upper and lower body exercises on land or in water. In addition, the system includes a lower limb encircling sleeve device. This device is comprised of two pouches joined by an adjustable rear strap and adjustable front strap to secure weight-containing pouches on the other side of lower leg, with a stirrup strap that runs beneath the foot. Pouches are sized to hold various sizes of collapsible weight chambers and closed fastenings at the top opening. This device enables a lower exercise or workout on land or in water.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
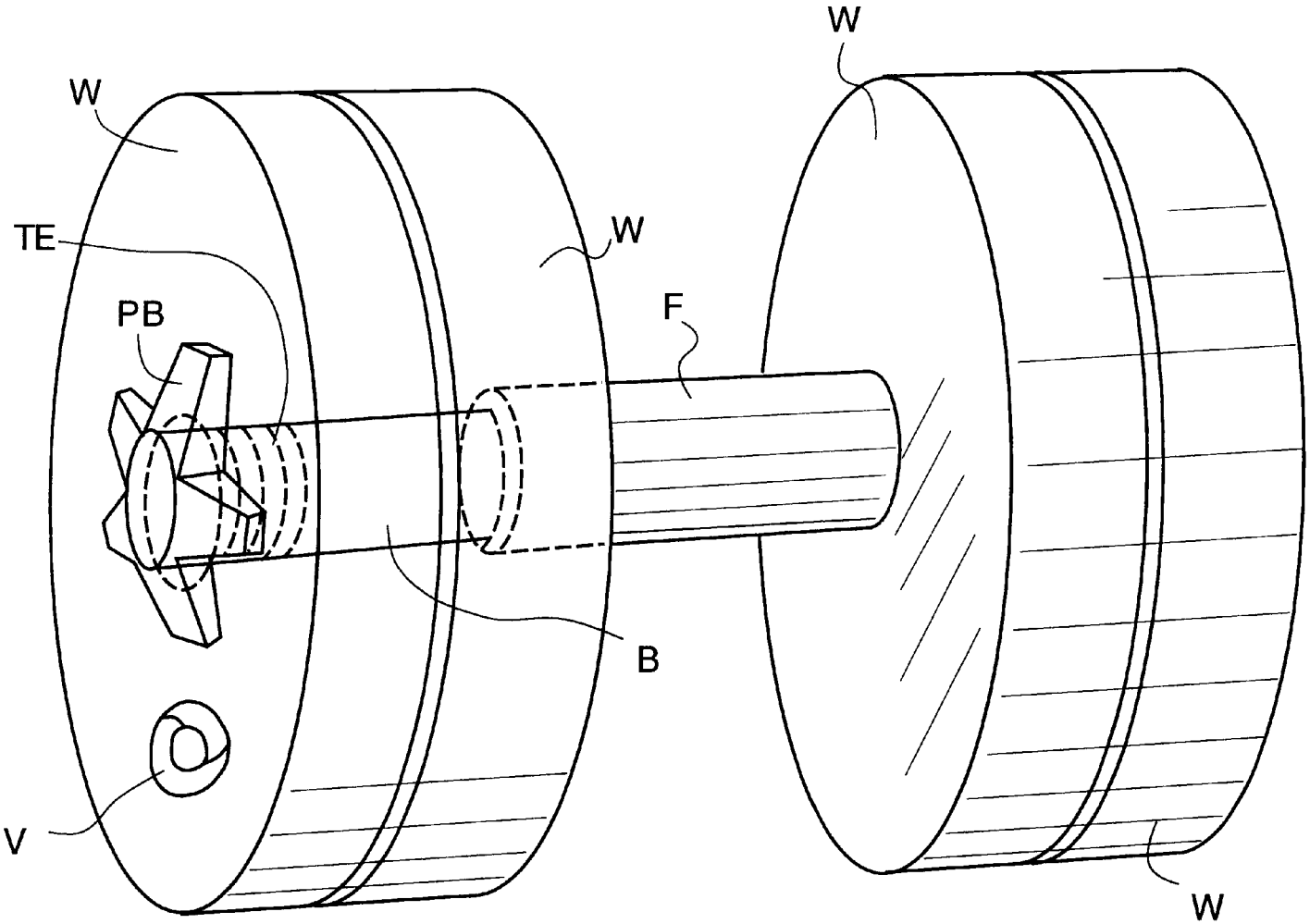
FIGURE 1 (PRIOR ART)
FIG. 1 is a isometric view of a prior art water-filled dumbbell commercial sold under the trademark AQUABELLS®.
Figure 2:
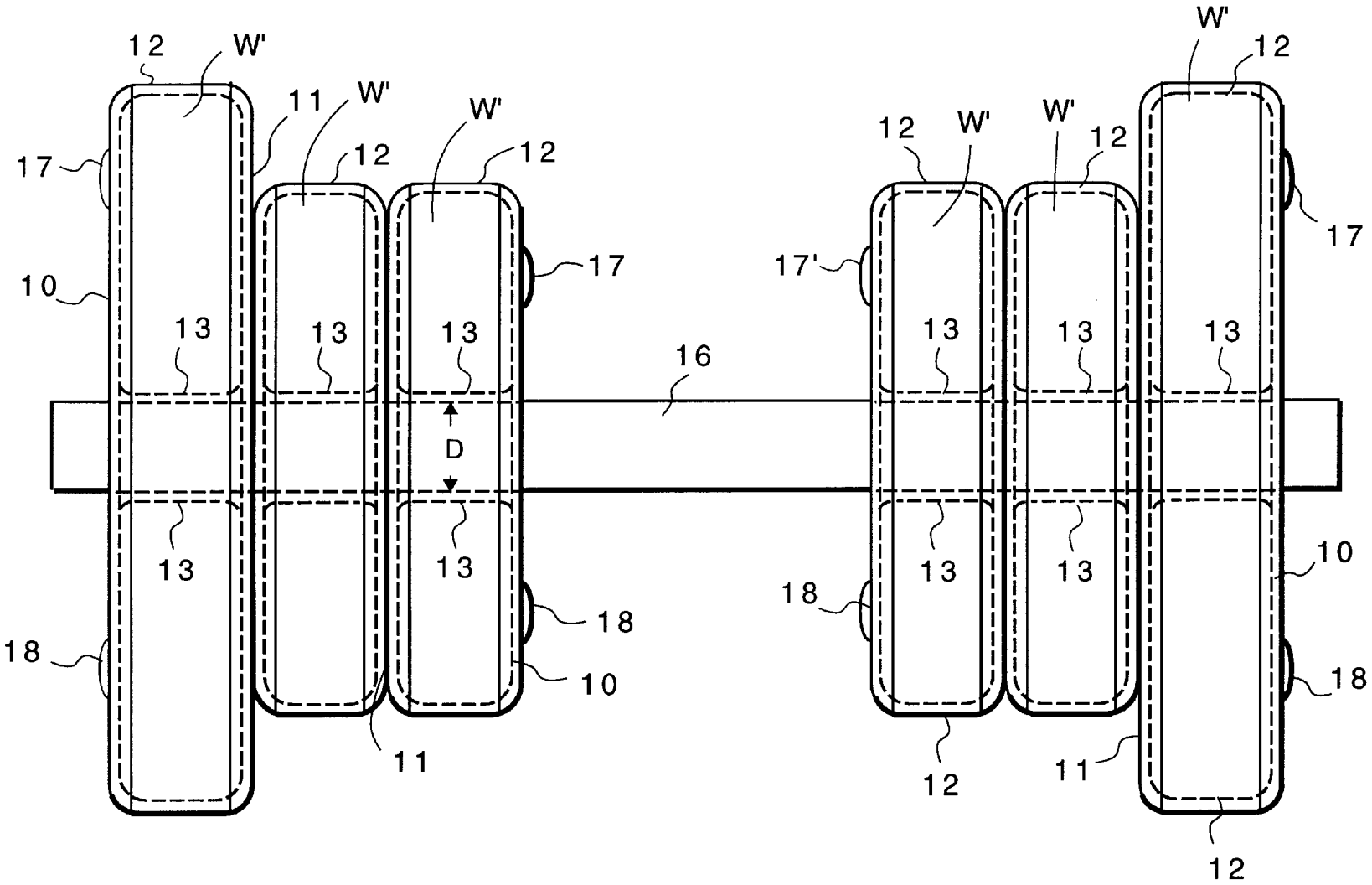
FIG. 2 is a sectional view of a dumbbell or barbell incorporating the weights of the present invention.
Figure 3:
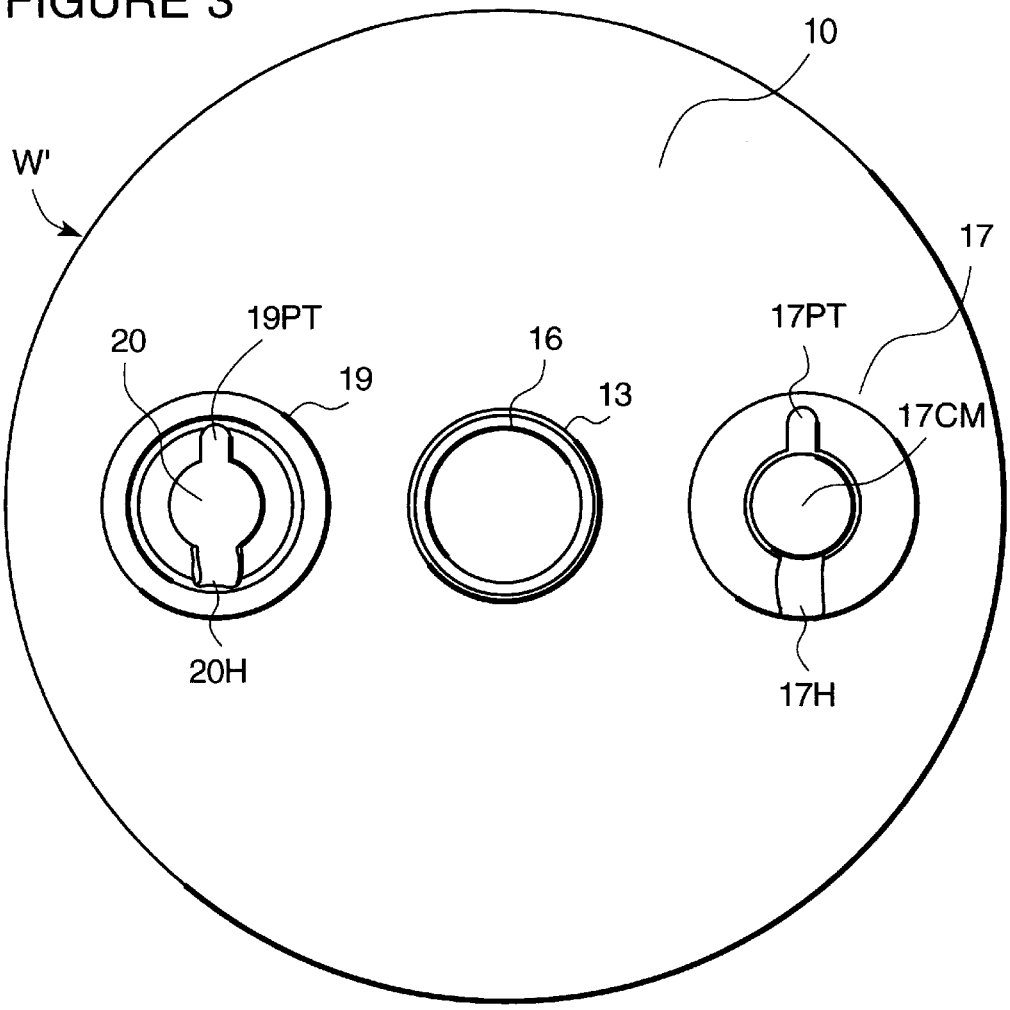
FIG. 3 is a top plan view of a collapsible weight chamber member incorporating the invention.
Figure 4:
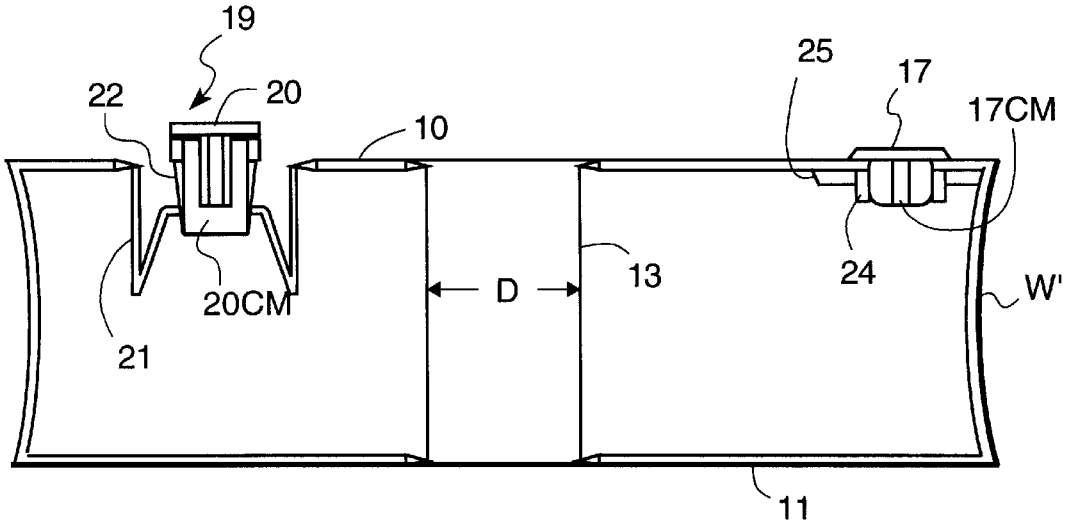
FIG. 4 is a sectional view through a weight chamber member showing the two-valve system.

The invention and its features are illustrated in FIGS. 2–10. In FIG. 2 the weight chamber members W' have a pair of flexible end members 10, 11 (even though the sizes vary, the same numbering is used) which are joined by first 12 and second 13 band members which are made of the same flexible materials, the second band 13 constitutes an opening having a diameter D so as to pass bar 16 therethrough. A water valve 17 and an air valve 18 are provided in the end members 10. As will be explained later, the location of the water-fill valve 17 is, in the preferred embodiment, located near the outer perimetrical or peripheral edge of the end members so that the valve closure element can be pressed into closing/sealing relation without expelling any significant water.

The air valve 18 is conventional in that it has a hinged 20H closure member 20, a securement flange 21 and a neck tube portion 22. If the weight is to be used in aquatic buoyancy resistance exercises, the valve is pulled up so that the lips of the person can surround the neck tube portion. The person then blows to inflate the chamber with air. Then the valve closure plug member 20 is closed so as to seal air in and pushed back down flush with end member 10. The buoyancy or water resistance can be adjusted by adjusting the amount of inflation or by admitting water into the chamber via water valve 17 or changing the number and/or size of chambers mounted onto the bar or inserted into the leg pouch. Water valve 17 is conventional and has a hinge flap 17H secured to closure plug member 17CM which is snugly received in water opening 24 which is sealingly mounted by flange 25 flush with the surface of end member 10. The water valve 17 is located close to the lateral peripheral edge of end member 10 so that after filling the chamber with water to a predetermined level (air valve 18 optionally being open during filling with water as well as when emptying water) it may be grasped between the thumb and forefinger for closing without expelling water (see FIG. 7). The air valve is closed first, any water expelled being made up through the water valve 17. Water valve pull tab 17PT and air valve pull tab 19PT are used to pull the respective valve closure member 17CM and 20CM from their respective opening.

Figure 5:
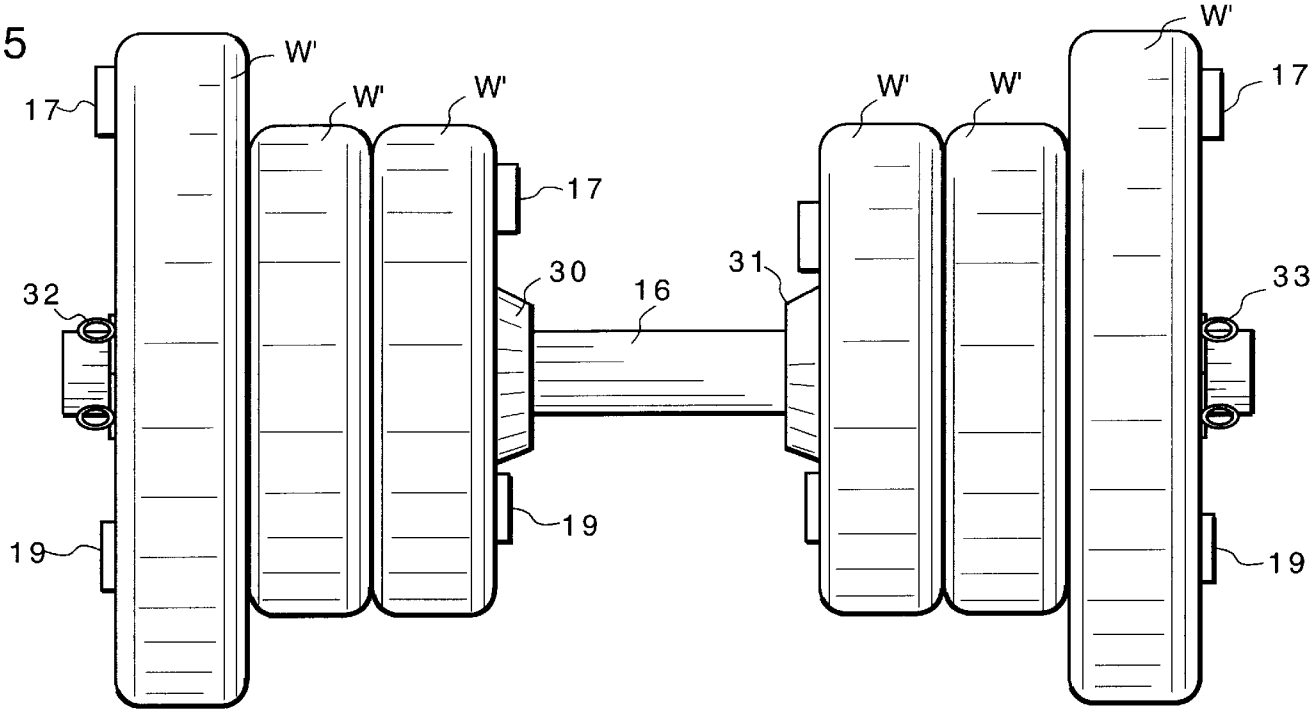
FIG. 5 is an illustration showing the collapsible weight chamber members secured on a bar.
Figure 6:
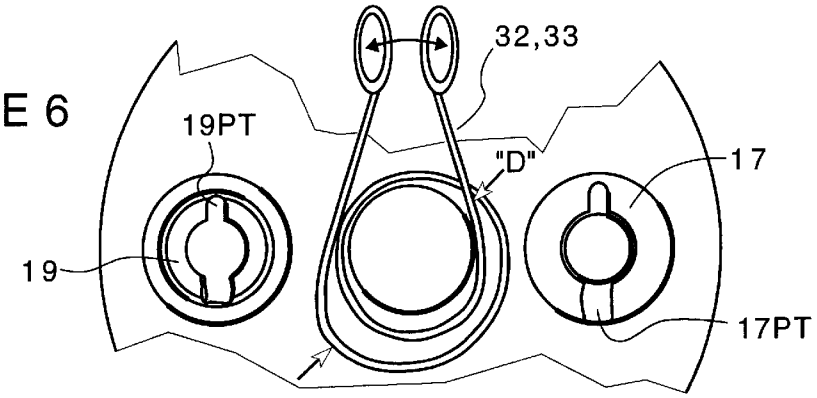
FIG. 6 is an end view illustrating spring clips squeezed "open" for securing the collapsible weight chamber members onto a dumbbell/barbell.
Figure 7:
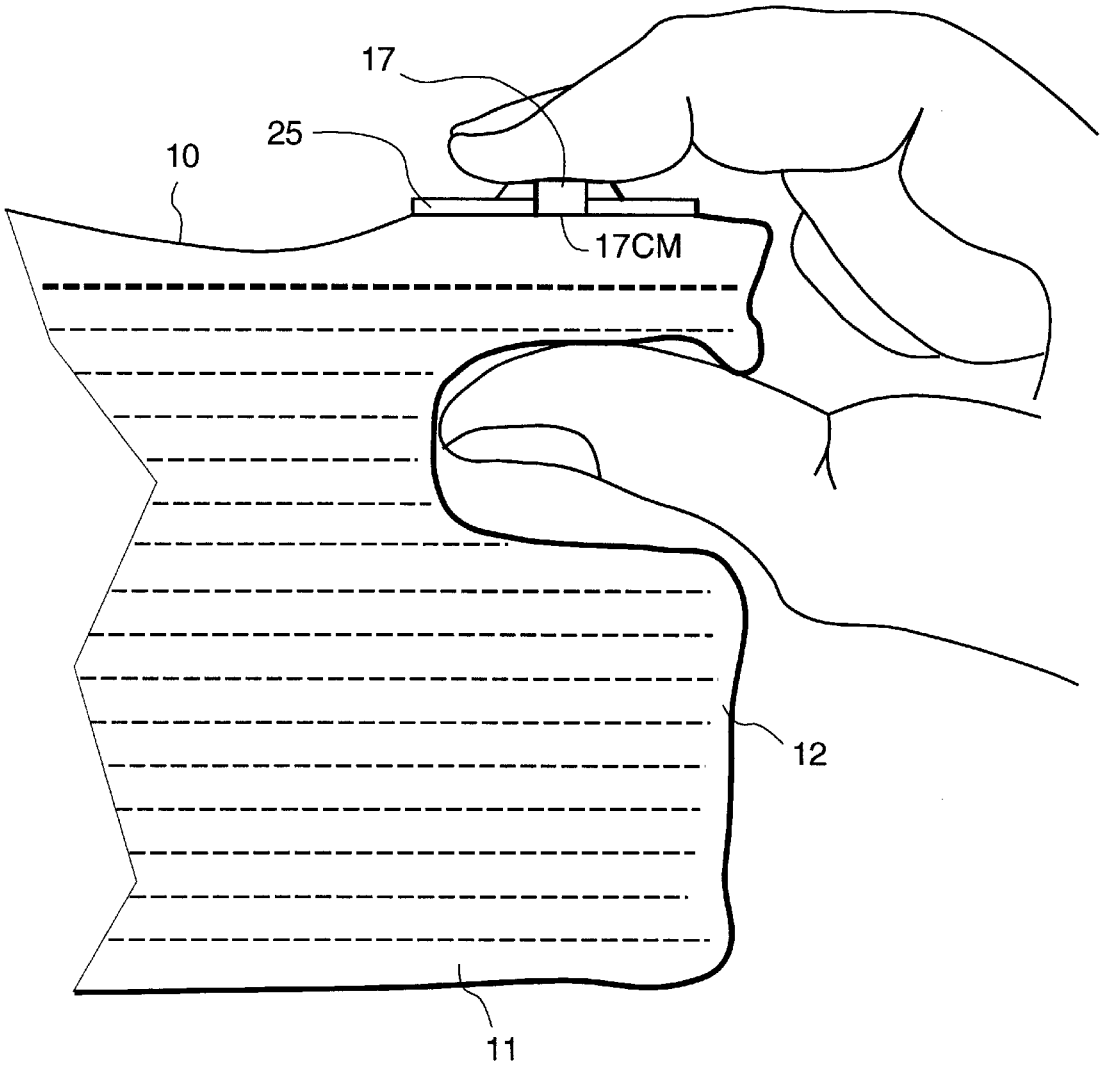
FIG. 7 is a sectional view showing the advantageous positioning of the water-filling valve adjacent the peripheral edge for closure and sealing by grasping between the thumb and forefinger.

As shown in FIGS. 5 and 6, for a dumbbell use after filling with water and closure of the valves as shown in FIG. 7, the weight chamber members W' are fitted on a bar 16 having stop collars 30, 31 thereon. Conventional spring clips 32, 33 are squeezed to enlarge their diameter, slid upon the ends of the bar 16 and released to allow them to close on and secure to the bar thereby safely securing the weights to bar 16.

Figure 8A:
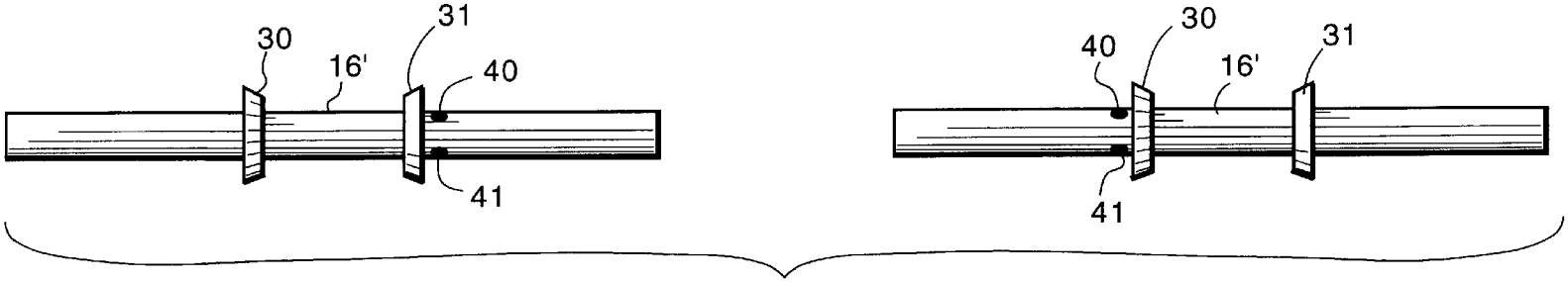
FIGS. 8A, 8B and 8C show how two dumbbell bars can be interconnected by a connecting bar with spring-loaded deadened pins.
Figure 8C:
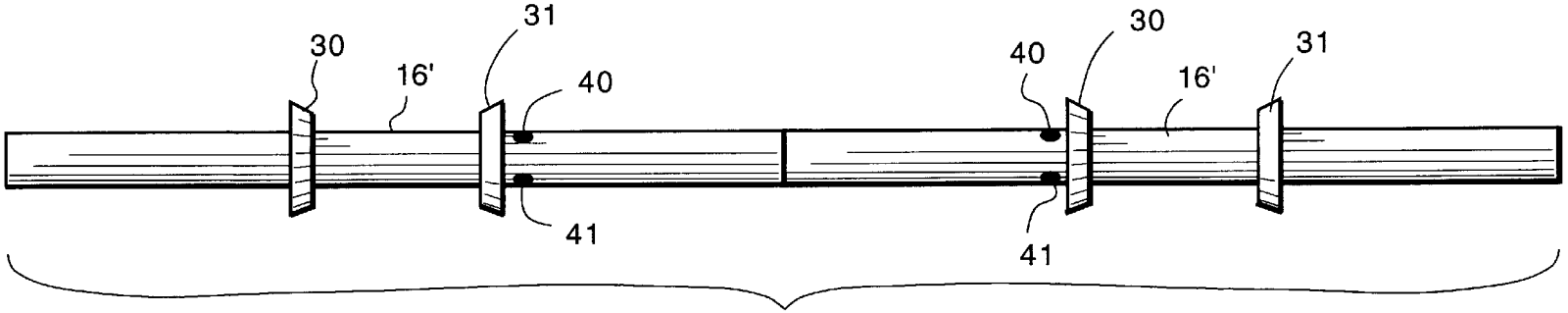
Figure 8B:
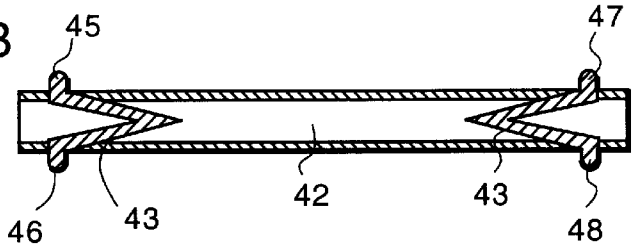

A dumbbell bars/collapsible barbell system is shown in FIGS. 8A, 8B and 8C. In this case, two dumbbell bars are each provided with one or more detent latch holes 40, 41. A connecting bar 42 (FIG. 8B) is provided near its lateral ends with spring-loaded detent pins 43, 44, each detent pin having pin members 45, 46 and 47, 48, respectively, which, when connector bar 42 is telescoped within the ends of bars 16' of FIG. 8A, are compressed inwardly. Upon reaching the detent latch holes 40, 41, the spring urges the pins 45, 46 and 47, 48 into the deadened latch holes 40, 41 to thereby secure the two bars 16' so they constitute and can be used as a barbell. The connecting bars 42, the cross-section shown with a corresponding section in at least a part of the bars 16' so as to facilitate alignment of pins 45, 46 and 47, 48 with detent holes 40 and 41.

Figure 9:
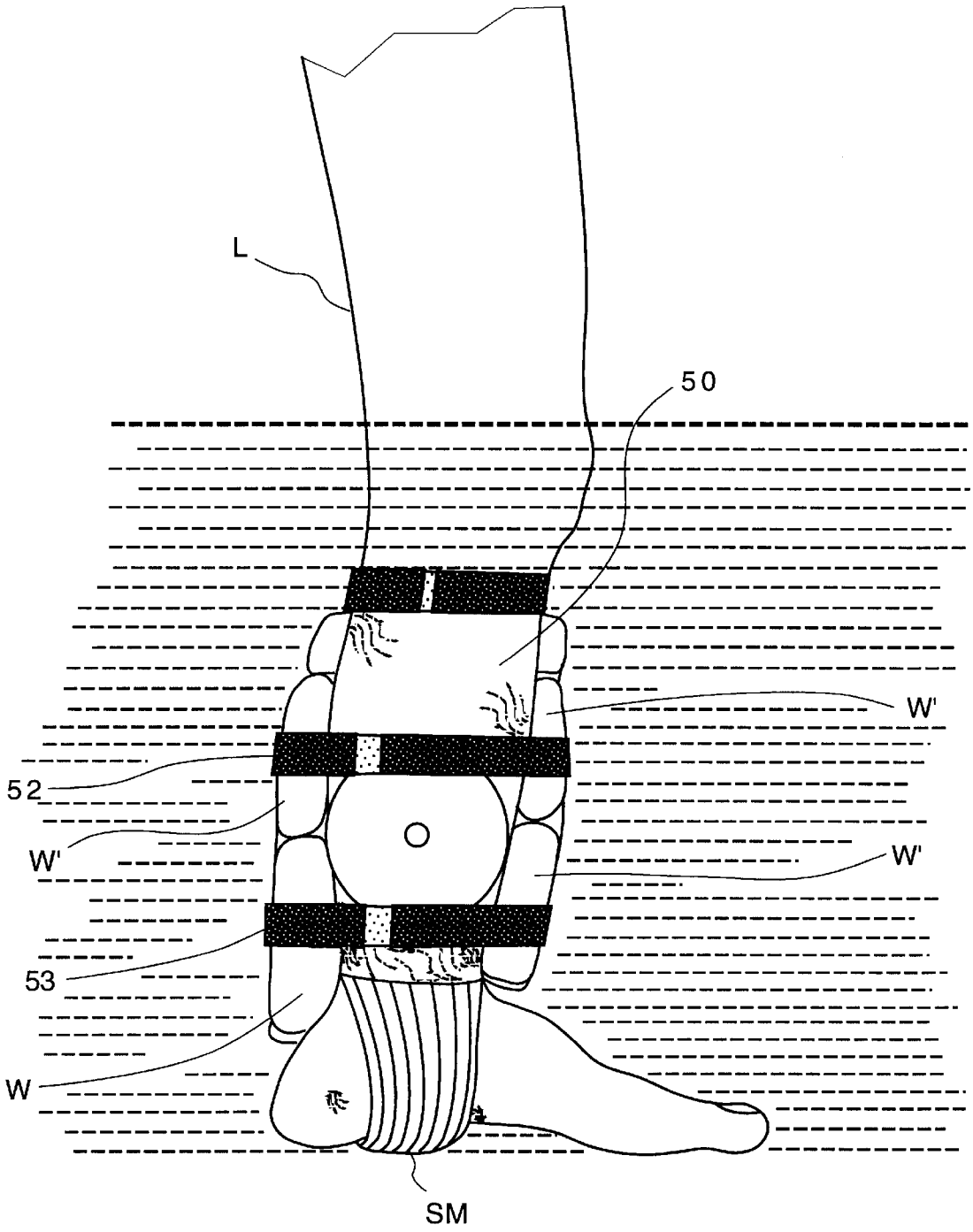
FIG. 9 is a diagrammatic illustration of the mounting of the collapsible weight chamber members on a body member or fitment arrangement.

When mounted on the leg or other portion of the human torso, land and aquatic exercises can be performed. In FIG. 9, we show various sizes of our weight members mounted on a leg L. Here a lower leg sock sleeve with pouches on either side 50 (with stirrup member SM) has secured thereto hook and loop fastener straps (Velcro™) 52. One weight member may be inserted into pouches located on either side of the leg sleeve, with each pouch closed by Velcro™ fasteners. Weights can be mounted on both sides of the lower calf (only one side being visible in FIG. 9). In this embodiment the weight chamber members W' can be filled with air and an assortment of weight/sizes are illustrated for performing various aquatic exercises where the buoyancy of the weight chamber members provide resistance underwater. Alternatively, the weight chamber members W' can be filled with water for land weight training.

While preferred embodiments of the invention have been illustrated and described, it will be understood that various other embodiments, adaptations and modifications will be readily apparent to those skilled in the art.

What is claimed is:

1. A portable aquatic/land weight training method comprising:

providing a plurality of collapsible chamber members, each of said collapsible chamber member being comprised of: a pair of flexible end members joined by first and second flexible band members forming a water- and air-tight chamber, said first band member forming an opening through said collapsible chamber member, said opening having a diameter D so as to pass a bar therethrough, and a water valve and water valve closure member for selectively filling said collapsible chamber member with water and an air valve having an extendible air-fill neck and closure member for selectively filling said collapsible chamber member with air and selectively filling said collapsible weight training chamber members with:

(a) air and mounting same on a bar or body part for use as an aquatic buoyancy resistance exercise, or (b) water and mounting same on a bar or body part for conventional weight training exercise.

2. The training method defined in claim 1 wherein said water-fill valve is mounted in one of said pair of flexible end members near a peripheral edge thereof so that, after filling with water, the water valve can be closed by grasping the water valve closure member and said peripheral edge by a pair of user's fingers to seal the water valve without significant expulsion of water.

* * * * *